US007677770B2

(12) United States Patent
Mazzochette

(10) Patent No.: US 7,677,770 B2
(45) Date of Patent: Mar. 16, 2010

(54) THERMALLY-MANAGED LED-BASED RECESSED DOWN LIGHTS

(75) Inventor: Joseph B. Mazzochette, Cherry Hill, NJ (US)

(73) Assignee: Lighting Science Group Corporation, Satellite Beach, FL (US)

( * ) Notice: Subject to any disclaimer, the term of this patent is extended or adjusted under 35 U.S.C. 154(b) by 232 days.

(21) Appl. No.: 11/621,131

(22) Filed: Jan. 9, 2007

(65) Prior Publication Data

US 2008/0165535 A1 Jul. 10, 2008

(51) Int. Cl.
*F21S 8/02* (2006.01)

(52) U.S. Cl. ..... 362/364; 362/373; 362/294; 362/345

(58) Field of Classification Search ..... 362/373, 362/294, 264, 345, 364; 361/694, 695, 697; 174/16.01, 16.3; 165/80.3, 104.33, 104.34, 165/122; 454/184
See application file for complete search history.

(56) References Cited

U.S. PATENT DOCUMENTS 3,518,420 A * 6/1970 Kripp ..... 362/257
4,630,182 A * 12/1986 Moroi et al. ..... 362/294
5,365,145 A * 11/1994 Fields ..... 315/86
5,758,956 A * 6/1998 Bornhorst et al. ..... 362/294
5,813,752 A * 9/1998 Singer et al. ..... 362/293
6,840,654 B2 1/2005 Guerrieri et al.
6,857,756 B2 2/2005 Reiff et al.
7,144,135 B2 * 12/2006 Martin et al. ..... 362/294
2005/0254241 A1 11/2005 Harwood
2005/0276053 A1 12/2005 Nortrup et al.

OTHER PUBLICATIONS

International Search Report and Written Opinion, International Searching Authority, International Application No. PCT/US2008/050566, mailed May 26, 2009.

* cited by examiner

*Primary Examiner*—Sharon E Payne
(74) *Attorney, Agent, or Firm*—Cantor Colburn LLP

(57) ABSTRACT

An LED down light replacement apparatus is disclosed for insertion into a recessed-light housing can, which includes an LED light source, a means for mounting said LED light source within the housing can, an LED driver circuit electrically connected to the LED light source, a heat sink in thermal contact with the LED light source, and means for removing heat generated by the LED light source. The means for removing heat generated by the LED light source can include a fan and/or ventilation holes in the top of the housing can.

27 Claims, 5 Drawing Sheets

THERMALLY-MANAGED LED-BASED RECESSED DOWN LIGHTS

FIELD OF THE INVENTION

The present invention relates generally to recessed lighting, and more particularly to an apparatus for retrofitting LED-based recessed lamps into incandescent or fluorescent recessed lighting fixtures.

BACKGROUND OF THE INVENTION

There are many types of lighting fixtures for the home or office which are known in the art. These include Edison based fixtures, surface mounted fixtures, track-lighting fixtures, and recessed fixtures. These fixtures have traditionally come in three types: incandescent, fluorescent, and high intensity discharge (HID) lights. All three suffer from inefficiency, relatively short life, and high heat dissipation. For example, incandescent lamps produce in the area of 14 to 17 lumens per watt. In addition, incandescent light sources use a thin filament which glows when heated by electrical power and tends to burn out easily. Typical, incandescent lamps have to be replaced every 2000 hours. Fluorescent lamps are an improvement over incandescent lamps, producing 50 to 120 lumens per watt, and lasting about 15,000 hours. HID lamps last about 20,000 hours.

To overcome inefficiency and to extend lifetime, LED-based lighting fixtures have been introduced. A white light can be produced by combining a blue led with a phosphor, or by combining red, green, and blue LEDs. These combination LEDs can be formed into incandescent-like bulbs and recessed cylindrical or rectangular fixtures. In order to avoid replacing the large base of existing incandescent-based recessed lights, LED light fixtures can be designed to be retrofitted into existing fluorescent rectangular or cylindrical "can" incandescent or fluorescent fixtures. The LED recessed lamps in the prior art, however, operate generally at low wattages, typically about three watts. If the wattage is raised to increase brightness, say to about 5-50 watts, the increased heat dissipation causes the LEDs to drift out of current-voltage specification, thereby introducing unwanted color variations and even failure. In some circumstances, depending on the thermal environment of an LED recessed lamp, ventilation may be needed for power dissipation as low as 2 watts (or a light output of about 100 lumens or more).

As such, there is a need in the art for an improved retrofittable LED-based recessed light that can operate at relatively high wattages without incurring color variations or risking failure at high output power.

SUMMARY OF THE INVENTION

The above-described problems are addressed and a technical solution is achieved in the art by an LED down light replacement apparatus for insertion into a recessed-light housing can, which includes an LED light source, a means for mounting the LED light source within the housing can, an LED driver circuit electrically connected to the LED light source, and means for removing heat generated by the LED light source. In some embodiments, the recessed-light housing can is part of the apparatus; in other embodiments, the apparatus is inserted into an existing housing can after removing an existing incandescent or fluorescent light assembly.

The means for removing heat generated by the LED light source can include a heat sink in thermal contact with the LED light source, and a fan and/or ventilation holes in the top of the housing can. When the apparatus includes a fan, the fan can be mounted on the heat sink or on a top surface of the housing can. The apparatus can include a trim and a ventilation cone with a conical flange protruding therefrom. Air is drawn in through the heat sink by the fan and directed between the fan and the housing can out through a space between the trim or housing can and the truncated conical flange of the ventilation cone.

The LED driver circuit converts AC current to constant DC current for driving the LED light source. The LED light source can include a plurality of blue LEDs coated with a phosphor, or a combination of red, green, and blue LED arrays.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION OF THE INVENTION

Figure 1:
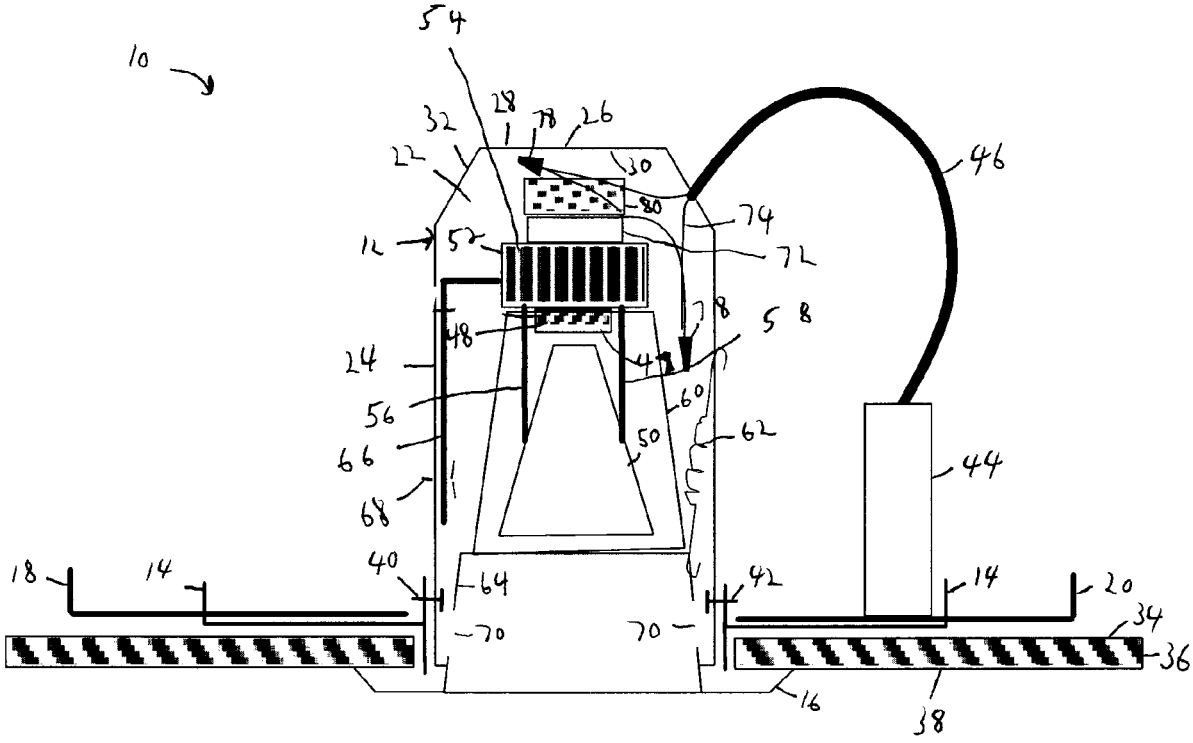
FIG. 1 is a schematic diagram of the structure of a retrofittable recessed "can"-type LED down light fixture, according to an embodiment of the present invention.

FIG. 1 is a schematic diagram of the structure of a retrofittable recessed LED down light fixture, according to an embodiment of the present invention, generally indicated at 10. The recessed lighting fixture 10 includes a housing can 12, base 14, generally annular trim 16, and mounting brackets 18, 20 interconnected as shown and defining an interior portion 22 of the lighting fixture 10. The housing can 12 includes a generally cylindrical wall portion 24 and circular top portion 26 having an upper surface 28 and a lower surface 30, connected by an angled truncated conical side portion 32. The mounting brackets 18, 20 are mounted between adjacent floor joists (not shown) with the base 14 resting on an upper surface 34 of a ceiling 36. The trim 16 extends from the can 12 and lies flush with a lower surface 38 of the ceiling 36. A pair of can-to-base attachment screws 40, 42 secure the base 14 to the mounting brackets 18, 20. A junction box 44 is mounted on the base 14 adjacent the can 12. A BX-type electrical conduit and cable 46 extends from the junction box 44 to the wall portion 24 of the can 12 for providing AC power to the lighting fixture 10.

An LED array assembly 47 is affixed or retrofitted to the interior 22 of the lighting fixture 10. The LED array assembly 47 includes an LED array 48 comprising parallel banks (not shown) of LEDs (not shown). A sealed reflector cone 50 focuses and directs light from the LED array 48 out of the light fixture 10. A heat sink 52 is mounted within the housing can 12. The heat sink 52 may be perforated with a plurality of vent holes 54. Mounting brackets 56, 58 mount the LED array assembly 47 to the can 12 and the heat sink 52 to the sealed reflector cone 50, respectively. The heat sink is also removably attached to an outer thermal ventilation cone 60. One or more trim retention springs 62 tensively connects a truncated conical flange 64 of the ventilation cone 60 to the wall portion 24 of the can 12, while the LED array adjustment bracket 66 extends from the heat sink 52 and mounts the LED array assembly 47 to another side of the wall portion 24 of the can 12 via an LED array position adjustment screw 68. The adjustment screw 68 and the bracket 66 allow for fine tuning of placement of the LED array assembly 47 within the interior 22 of the light fixture 10. Means for mounting the LED array assembly 47 within the housing can 12 can include other structures known in the art, including but not limited to screws, rivets, clamps, straps, weld, crimped metal, etc. The position of the mounting bracket 66 in relation to the ventilation cone 60 is such that openings 70 for escaping hot air exist between the flange 64 and the trim 16 or the can 12. Aspects of ventilation of air to carry away heat from the fixture 10 will be discussed below in connection with FIGS. 3 and 4.

An LED driver circuit 72 is electrically connected to the LED array 48 for providing constant DC current to each of the banks of LEDs. In the present embodiment, the heat sink 52 is mounted in thermal contact with the LED driver circuit 72 and the LED array assembly 47 and internally with respect to the can 12. In other embodiments, the LED driver circuit 72 can be mounted externally on the base 14 outside of the can 12, including on or in the electrical junction box 44. AC power leads 74 extend from the BX-type electrical conduit and cable 46 into the interior 22 of the lighting fixture 10 and are electrically connected to power leads 76 of the LED driver circuit 72 via wire wrap screws 78. Electrical connections (not shown) between the LED array 48 and the LED driver circuit 72 can be made through or around the heat sink 52. In the present embodiment, a fan 80, preferably a low noise fan, is mounted above LED driver circuit 72. The fan 80 is located within the interior 22 of the lighting fixture 10 below or in contact with the lower surface 30 of the circular top portion 26 of the can 12. In other embodiments, the fan 80 can be mounted exterior to the light fixture 10 above the upper surface 28 of the circular top portion 26 of the can 12. Certain parts common to most or all recessed lights have been omitted from FIG. 1 for simplicity of the drawings but are nevertheless present in the present embodiment. These include various screws, a lens inserted within the trim 16, and an optional secondary optic.

Figure 2:
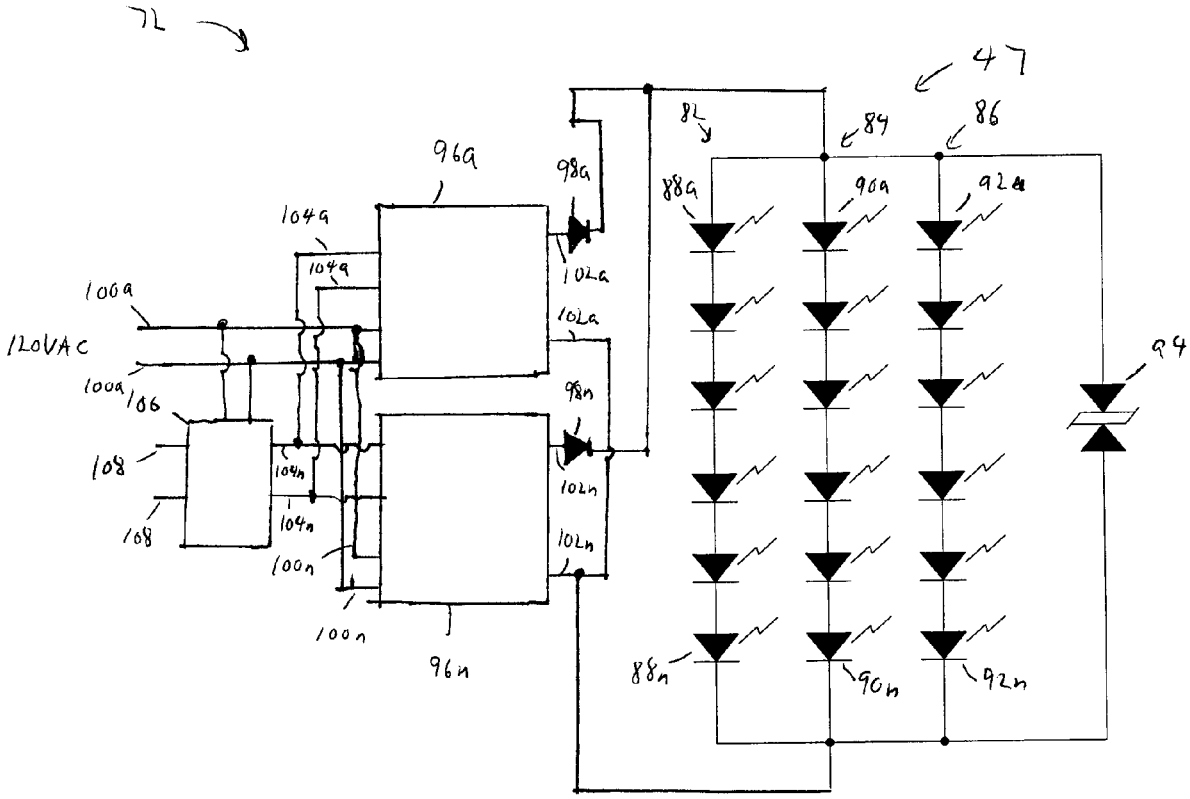
FIG. 2 is an electrical schematic diagram of a constant current source driver circuit for operating the LEDs contained in the LED light fixture of FIG. 1.

FIG. 2 is an electrical schematic diagram of a constant current source driver circuit 72 for operating the LED array 48 in the LED light fixture 10 of FIG. 1. The LED array 48 includes series/parallel connections of a bank 82 of LEDs 88*a*-88*n*, a bank 84 of LEDs 90*a*-90*n*, and a bank 86 of LEDs 92*a*-92*n*. In a preferred embodiment, each of the banks of LEDs 82, 84, 86 include blue LEDs coated with a phosphor to produce white light. Alternatively, each of the banks 82, 84, 86 can be composed of series/parallel connections of any combination and number of red, green, and blue LEDs. The banks of LEDs 82, 84, 86 can be protected from an overvoltage by means of a varistor 94. In a preferred embodiment, the banks of LEDs 82, 84, 86 and the varistor 94 are included in a single integrated package, such as the NT-52D1-0430, manufactured by Lamina Ceramics, Inc. In other embodiments, each of the LEDs can be discrete, or come in multicolor die packages. The banks 82, 84, 86 of LEDs are driven by one or more LED driver circuits 96*a*-96*n* connected in parallel and protected from reverse currents by diodes 98*a*-98*n*. The number of LED driver circuits 96*a*-96*n* needed depends upon the current drive requirements of the banks of LEDs 82, 84, 86. In a preferred embodiment, approximately 1400 mA is needed to optimally drive the NT-52D1-0430 LED array device. This is accomplished by connecting a pair of LED drivers in parallel, each of which can drive up to about 700 mA, such as a pair of LED 120A0700C24F Xitanium LED drivers from Advance, Inc. The LED driver circuits 96*a*-96*n* have inputs 100*a*-100*n* for providing 120V AC main voltage to the LED driver circuits 96*a*-96*n* and a pair of DC outputs 102*a*-102*n* for providing DC current to the banks of LEDs 82, 84, 86. The LED driver circuits 96*a*-96*n* can optionally be provided with a pair of inputs 104*a*-104*n* to provide dimmer control of the banks of LEDs 82, 84, 86 by means of pulse width modulation techniques, as is known in the art. For example, the LED driver circuits 96*a*-96*n* can be LED0024V10B Xitanium LED drivers from Advance, Inc., which have a pair of light dimming inputs 104*a*-104*n*. The predetermined DC output current is converted to an AC output signal having a rectangular shape with a duty cycle which varies between 0% and 100% when a DC voltage is varied between 0 V to 10 V at inputs 104*a*-104*n*. The DC inputs 104*a*-104*n* can be driven directly from a DC source, or can be derived from 120V AC main power via a light dimming circuit 106. The light dimming circuit 106 can be driven at inputs 108 by a traditional thyristor based AC light dimmer, whose output signal is converted to a proportional DC voltage in the range of 0 V-10 V. Those skilled in the art would know how to convert an AC voltage with a variable duty cycle to a proportional DC voltage.

Figure 3:
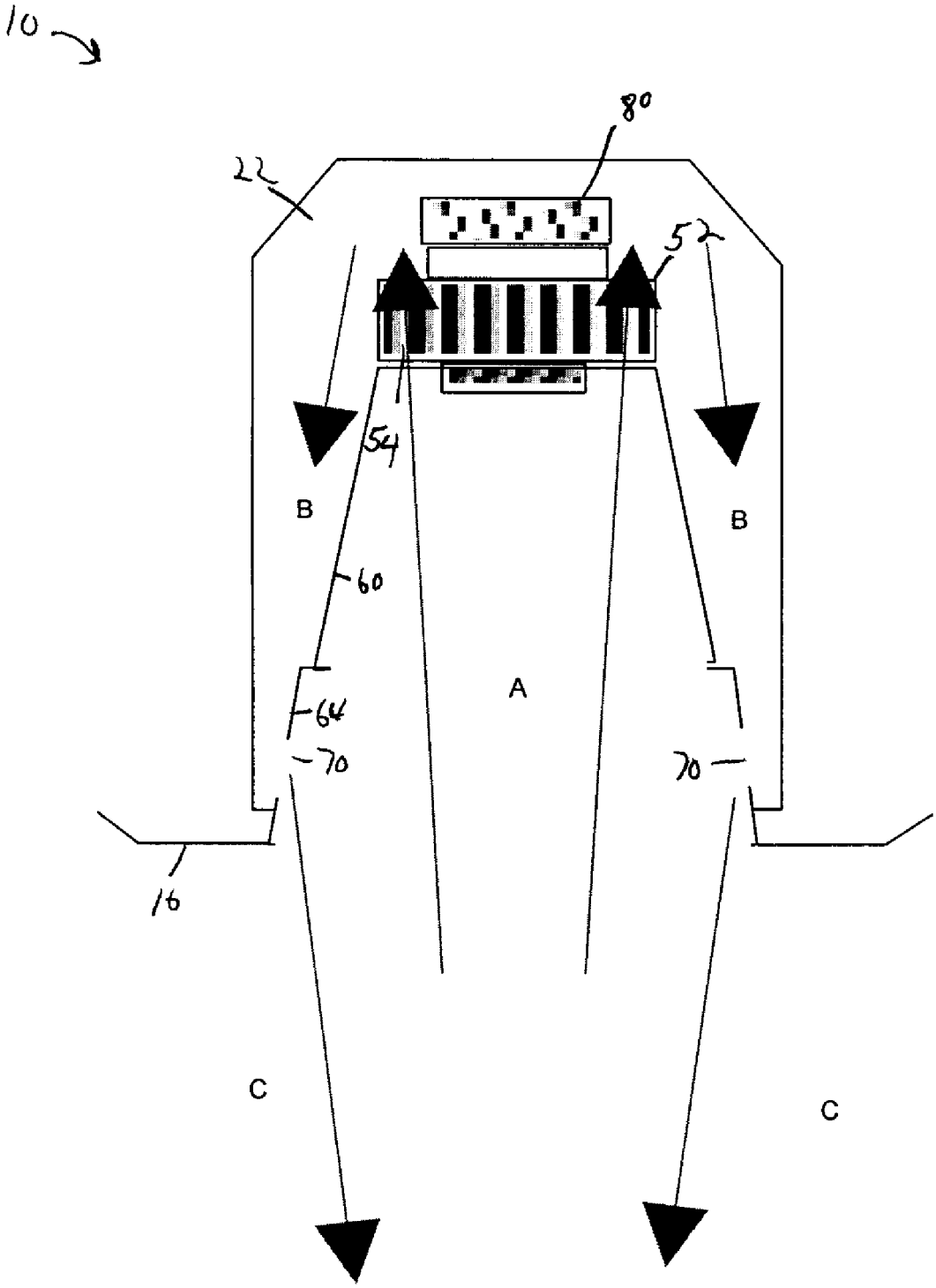
FIG. 3 is a schematic diagram showing how air is circulated to remove heat from the LED light fixture of FIG. 1.

FIG. 3 is a schematic diagram showing how air is circulated to remove heat from the LED light fixture of FIG. 1. Air is drawn into the can 12 of the light fixture 10 through the ventilation cone 60 by the fan 80 through the vent holes 54 in the heat sink 52 (arrows A). The now hot air is drawn through fins in the heat sink 52, through the fan 80 and is then forced down into the interior 22 of the lighting fixture 10 between the can 12 and the ventilation cone 60 (arrows B). Cooler air is exhausted through the openings 70 between the flange 64 and the trim 16 (arrows C) or can 12.

In an alternative embodiment, the heat sink 52 has no vent holes. An LED array assembly 47 includes a fan which is mounted above a heat sink, and the heat sink is mounted above an LED array 48. The LED array assembly is suspended within an open ventilation cone. Air is drawn into the can 12 of the light fixture 10 through the open ventilation cone by the fan 80 through fins in the heat sink 52, thence through the fan 80. The air is then forced down into the interior 22 of the lighting fixture 10 between the can 12 and the open ventilation cone. Cooler air is exhausted through the openings 70 between the flange 64 and the trim 16 or the can 12.

Figure 4:
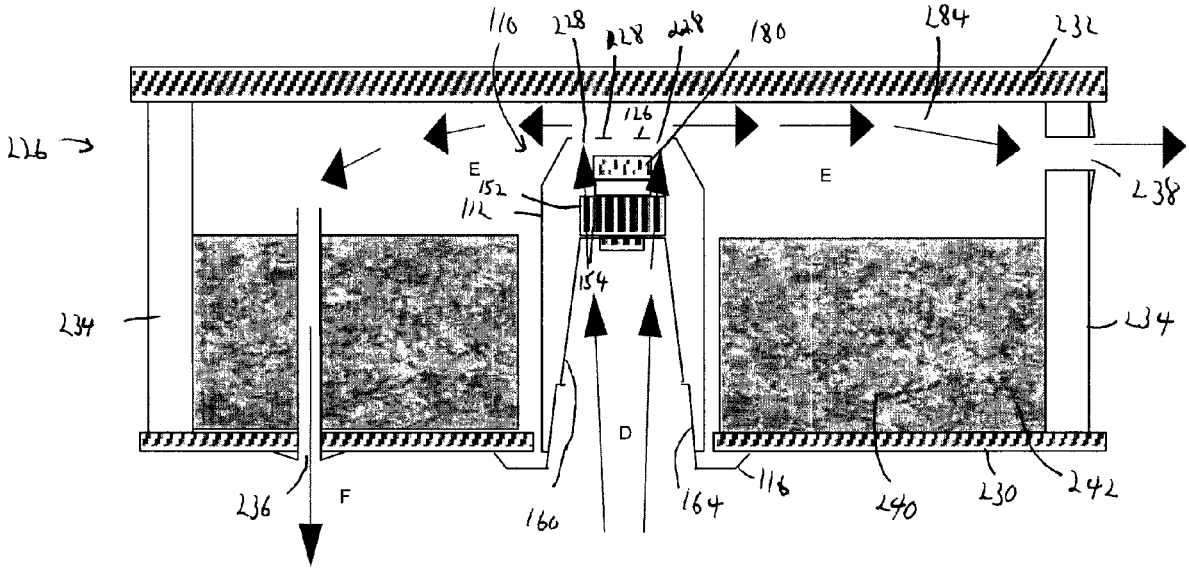
FIG. 4 is a schematic diagram showing how heat is ventilated in closed spaces according to a second embodiment of the present invention.

FIG. 4 depicts another alternate embodiment of the lighting fixture shown in FIGS. 1-3. Elements illustrated in FIG. 4 which correspond to the elements described above in connection with the embodiment of FIGS. 1-3 have been identified by corresponding reference numbers increased by one hundred. Unless otherwise indicated, both embodiments have the same construction and operation.

FIG. 4 shows how heat is ventilated in closed spaces according to a second embodiment of the present invention. A lighting fixture 110 is inserted into a closed-space ceiling structure 226. The lighting fixture 110 includes a can 112, which has a circular top portion 126 having an upper surface 128 which can be perforated by a plurality of vent holes 228. Openings are not provided between the flange 164 and the trim 116. A fan 180, preferably a low noise fan, may or may not be provided. The ceiling structure 226 includes a ceiling 230 and a floor 232 above the ceiling 230 separated by a plurality of floor joists 234. A ceiling vent 236 is provided in the ceiling 230, while an optional exterior vent 238 may be provided in the floor joists 234. Optional insulation 240 can cover a lower portion 242 of the ceiling structure 226 between the plurality of floor joists 234, the ceiling vent 236, and the lighting fixture 110, thereby defining an interior space 244 between the insulation 240 and the floor 232.

In operation, air is drawn through the ventilation cone 160 by the optional fan 180 or by natural convection (arrows D). The now hot air rises or is drawn in through the vent holes 154 in the heat sink 152. The air is drawn through fins in the heat sink 152, through the fan 180, and exits through the vent holes 184 in the circular top portion 126 of the can 112. The warm air (arrows E) is cooled in the interior space 244, becoming heavier. The cooler air exits though the ceiling vent 236 and the optional exterior vent 238 (arrows F).

Figure 5:
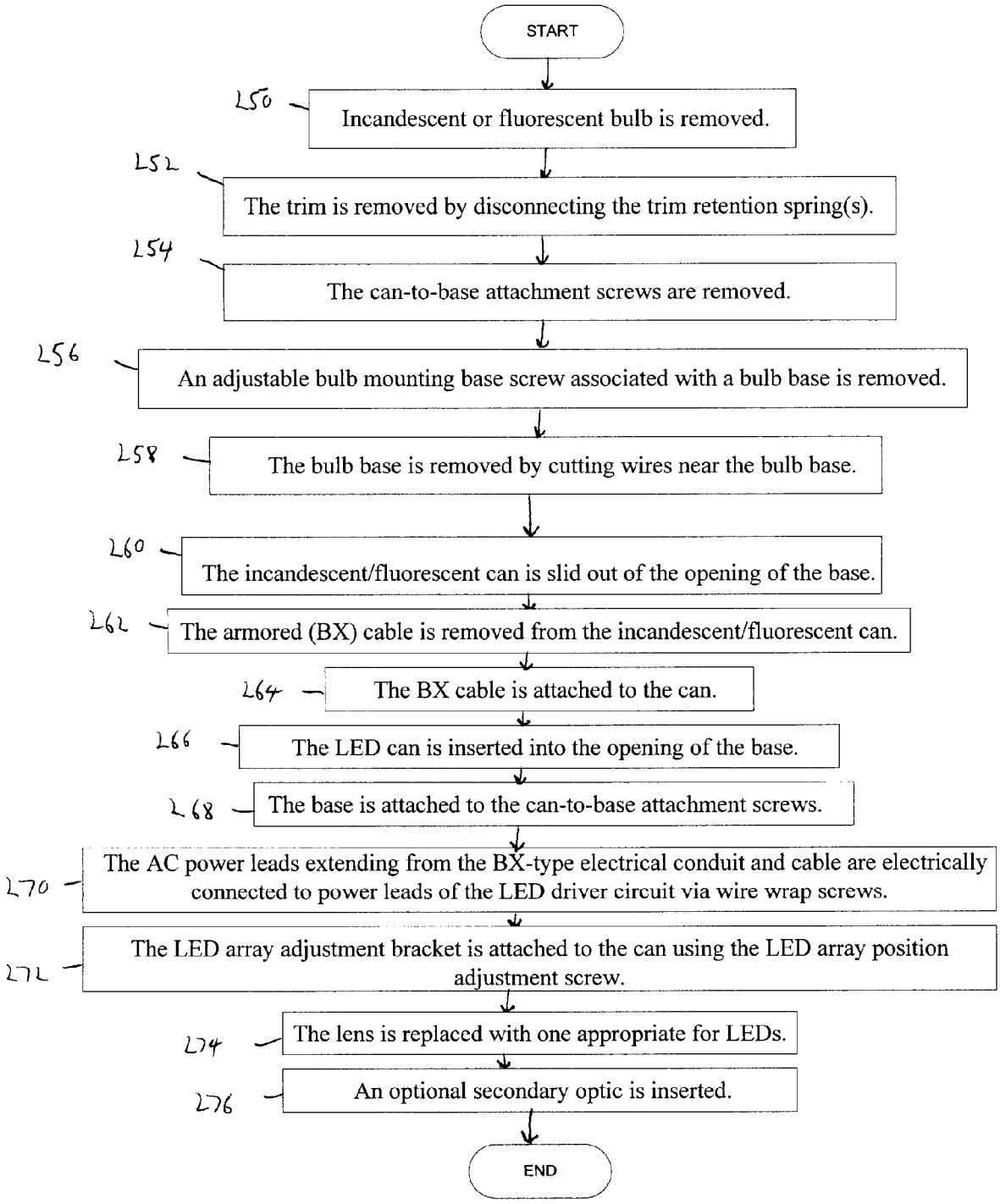
FIG. 5 is a flow chart illustrating the steps for retrofitting the LED light of FIG. 1 into existing incandescent or fluorescent fixtures.

FIG. 5 is a flow chart showing the steps for retrofitting the LED light of FIG. 1 into existing incandescent or fluorescent fixtures. For illustrative purposes, it is assumed that a traditional incandescent or fluorescent recessed lighting fixture shares the same mechanical parts as the embodiments of the present invention except for those parts associated with the LED array assembly 47, unless otherwise noted. At step 250, an incandescent or fluorescent bulb is removed. At step 252, the trim 16 is removed by disconnecting the trim retention spring(s) 62. At step 254, the can-to-base attachment screws 40, 42 are removed. At step 256, an adjustable bulb mounting base screw associated with a bulb base is removed. At step 258, the bulb base is removed by cutting wires near the bulb base. At step 260, the incandescent/fluorescent can is slid out of the opening of the base 14. At step 262, the armored (BX) cable 46 is removed from the incandescent/fluorescent can. At step 264, the BX cable 46 is attached to the can 12. At step 266, the LED can 12 is inserted into the opening of the base 14. At step 268, the base 12 is attached to the can-to-base attachment screws 40, 42. At step 270, the AC power leads 74 extending from the BX-type electrical conduit and cable 46 are electrically connected to power leads 76 of the LED driver circuit 72 via wire wrap screws 78. At step 272, the LED array adjustment bracket 66 is attached to the can 12 using the LED array position adjustment screw 68. At step 274, the lens is replaced with one appropriate for LEDs. At step 276, an optional secondary optic is inserted.

The present invention has been described in the context of "can insert"-type LED down light fixtures 10, 110. In a can-insert type LED down light fixture, the can does not need to be replaced. A separate housing insert is mounted inside the existing luminaire housing. The new separate housing contains the LED array, heat sink, and optional driver, optic, and fan. The present invention is also applicable to other LED recessed down light fixture types known in the art, such as can-replacement-type and LED module insert type down light fixtures. In a can-replacement-type fixture, the entire housing can is removed and replaced with a housing containing the LEDs, heat sink, and optional driver, optic, and fan. In the LED module insert type fixture, a separate LED array assembly is mounted inside the existing housing can. The LED array assembly includes a heat sink, and optional driver, optic, and fan. The advantage of this approach is that the installer is not required to perform any complicated or potentially performance degrading assembly of the LED, heat sink, fan, etc.; i.e., it does not require that the housing be replaced. For a can-replacement-type fixture, the LED array assembly 47 can be equipped with a fan 80 mounted above a heat sink 52 located within the interior 22 of a lighting fixture 10, or the fan 80 can be mounted exterior to the light fixture 10 above the upper surface 28 of the circular top portion 26 of the can 12. For all of the light fixture types herein described, instead of forced air cooling with a fan 80, the light fixture 10 can be cooled by air convection alone via vent holes 184 in the circular top portion 126 of the can 112.

The present invention presents numerous advantages over the prior art down light fixtures. Using an LED light source instead of an incandescent or fluorescent reduces energy consumption, improves the longevity of the fixture, eliminates toxic chemicals (e.g., mercury in fluorescents), increases fire safety, and is more shock and vibration resistant. The present invention can operate at higher power levels than current LED-based down lights, and hence brighter LED operation, because of the means of removing heat from the assembly. Using one of the ventilation schemes described in FIGS. 1-4, embodiments are capable of removing heat without affecting the specifications of the LED arrays 48, 148 for a recommended full power rating of up to 150 watts or higher. The power level needed will depend on the particular LED light source and the lighting application. Ordinary indoor general illumination applications comparable to typical incandescent indoor spot and flood light recessed lights having wattages in the 100-150 watt range, for example, can be served by packaged LED white light engines operating in the 5-50 watt range.

It is to be understood that the exemplary embodiments are merely illustrative of the invention and that many variations of the above-described embodiments may be devised by one skilled in the art without departing from the scope of the invention. It is therefore intended that all such variations be included within the scope of the following claims and their equivalents.

What is claimed is:

1. An LED down light replacement apparatus for insertion into a recessed-light housing can, comprising:
- a reflector cone;
- a ventilation cone disposed about said reflector cone, said ventilation cone and said housing can defining a gap;
- an LED light source positioned adjacent said reflector cone;
- means for mounting said LED light source, said reflector cone, and said ventilation cone within the housing can;
- an LED driver circuit electrically connected to said LED light source; and,
- means for removing heat generated by said LED light source, wherein said means for removing heat includes:
- a fan arranged between said ventilation cone and said housing can to move air from within said ventilation cone and past said LED light source and through said gap; and,
- a heat sink in thermal communication with said LED light source and mounted between said ventilation cone and said fan.

2. The LED down light replacement apparatus of claim 1, wherein said fan is a low noise fan.

3. The LED down light replacement apparatus of claim 1, wherein said ventilation cone is mounted substantially below said heat sink.

4. The LED down light replacement apparatus of claim 1, wherein said means for removing heat generated by said LED light source further includes:
- a top portion of said housing having one or more vent holes; and,
- wherein said heat sink receives air through said ventilation cone, said air being thence directed out through the vent holes in said top portion of said housing can in a direction substantially opposite a direction light is emitted from said LED light source.

5. The LED down light replacement apparatus of claim 1, further including an electrical junction box for supplying AC current to said LED driver circuit, wherein said LED driver circuit is mounted in or overlying said junction box.

6. The LED down light replacement apparatus of claim 1, wherein said LED light source further comprises one or more blue LEDs coated with a phosphor to produce white light.

7. The LED down light replacement apparatus of claim 1, wherein said LED light source operates at a recommended full power rating in the range of about 2 watts and 150 watts.

8. The LED down light replacement apparatus of claim 7, wherein said LED light source operates at a recommended full power rating in the range of about 5 watts and 50 watts.

9. The LED down light replacement apparatus of claim 1, wherein said LED light source produces at least 100 lumens.

10. An LED down light apparatus, comprising:

an LED light source;

a recessed-light housing can comprising means for mounting said LED light source within said housing can;

a ventilation cone coupled between said LED light source and said housing can, said ventilation cone defining a substantially hollow interior portion having an open end, said ventilation cone and said housing can defining a gap therebetween, said ventilation cone further having a plurality of vent holes between said gap and said hollow portion adjacent said open end;

an LED driver circuit electrically connected to said LED light source; and, means for removing heat generated by said LED light source, wherein said means for removing heat is positioned between said ventilation cone and said housing can, said means for removing heat being arranged to direct air from said ventilation cone inner portion through said gap and out said plurality of vent holes into said interior portion.

11. The LED down light apparatus of claim 10, wherein said means for removing heat generated by said LED light source further comprises a heat sink in thermal communication with said LED light source and wherein said heat sink is thermally disposed between said LED light source and said vent holes.

12. The LED down light apparatus of claim 11, wherein said means for removing heat generated by said LED light source further comprises a fan for directing heat generated by said light source through said vent.

13. The LED down light apparatus of claim 12, wherein said fan is a low noise fan.

14. The LED down light apparatus of claim 12, wherein said fan is mounted within said housing can.

15. The LED down light apparatus of claim 12, wherein air is received from said interior portion which is drawn past said heat sink through said fan, said air being thence directed out through said plurality of vent holes and into said interior portion.

16. The LED down light apparatus of claim 15, wherein said heat sink includes one or more vent holes for receiving air which is drawn in from said inner portion.

17. The LED down light replacement apparatus of claim 15, wherein said ventilation cone is thermally conductive.

18. The LED down light apparatus of claim 12, wherein said ventilation cone is mounted proximate said heat sink.

19. The LED down light apparatus of claim 18, wherein said ventilation cone is mounted substantially below said heat sink.

20. The LED down light apparatus of claim 12, further comprising an electrical junction box for supplying AC current to said LED driver circuit, wherein said LED driver circuit is mounted in or overlying said junction box.

21. The LED down light apparatus of claim 12, wherein said LED light source further comprises one or more blue LEDs coated with a phosphor to produce white light.

22. The LED down light apparatus of claim 12, wherein said means for mounting said LED light source within said housing can comprises an adjustment bracket which extends from said heat sink and is sized and shaped for adjustable attachment with a wall of said housing can.

23. The LED down light apparatus of claim 22, wherein said means for mounting said LED light source within said housing can further comprises a position adjustment screw for securing an end of said adjustment bracket to the wall of said housing can, wherein said adjustment screw allows for adjustment of the placement of said LED light source within said housing can.

24. The LED down light apparatus of claim 15, further comprising a trim mounted to said housing can; and, a secondary optic mounted within said trim.

25. The LED down light apparatus of claim 10, wherein said LED light source operates at a recommended full power rating in the range of about 2 watts and 150 watts.

26. The LED down light apparatus of claim 25, wherein said LED light source operates at a recommended full power rating in the range of about 5 watts and 50 watts.

27. The LED down light apparatus of claim 10, wherein said LED light source produces at least 100 lumens.

* * * * *